US012774133B2

(12) United States Patent
Treadway Fancher

(10) Patent No.: US 12,774,133 B2
(45) Date of Patent: Oct. 27, 2026

(54) LID AND METHOD FOR PRODUCING/MANUFACTURING THERMOFORMED DISPOSABLE LID FOR A DRINKING CUP WITH INTEGRATED STRAW MOUTHPIECE PORTION AND MULTI-LEVEL PUNCH

(71) Applicant: Rebecca Ann Treadway Fancher, West Monroe, LA (US)

(72) Inventor: Rebecca Ann Treadway Fancher, West Monroe, LA (US)

( * ) Notice: Subject to any disclaimer, the term of this patent is extended or adjusted under 35 U.S.C. 154(b) by 0 days.

(21) Appl. No.: 17/656,061

(22) Filed: Mar. 23, 2022

(65) Prior Publication Data

US 2022/0306351 A1 Sep. 29, 2022

Related U.S. Application Data

(60) Provisional application No. 63/166,631, filed on Mar. 26, 2021.

(51) Int. Cl.
*B65D 43/02* (2006.01)
*B65D 51/16* (2006.01)

(52) U.S. Cl.
CPC ..... *B65D 43/0208* (2013.01); *B65D 51/1644* (2013.01); *B65D 2543/00046* (2013.01)

(58) Field of Classification Search
CPC ..... A47G 619/2272; B65D 43/0208; B65D 51/1605; B65D 2543/00046; B65D 47/06
See application file for complete search history.

(56) References Cited

U.S. PATENT DOCUMENTS 4,412,629 A * 11/1983 Dart ..... B65D 21/0219 220/254.1
10,676,254 B2 6/2020 Villarrubia
2002/0038803 A1* 4/2002 Malcolm ..... B65D 47/06 220/731
2002/0158075 A1* 10/2002 Caldicott ..... A47G 19/2272 220/717
2003/0066839 A1* 4/2003 Connors, Jr. ..... B65D 47/10 220/717
2010/0243722 A1* 9/2010 Hyder ..... B65D 43/0208 493/171
2019/0367223 A1* 12/2019 Villarrubia ..... B65D 43/0204
2020/0024039 A1* 1/2020 Chou ..... B65D 43/0212

* cited by examiner

*Primary Examiner* — Jeffrey R Allen
(74) *Attorney, Agent, or Firm* — Brannon Sowers & Cracraft PC

(57) ABSTRACT

A disposable lid for a drinking cup comprised of polymeric material formed as a single piece combination straw and lid as a means for drinking beverages from a cup by method of tipping and sipping and manufactured by method of thermoforming in a manner involving a multiple level punch.

8 Claims, 6 Drawing Sheets

LID AND METHOD FOR PRODUCING/MANUFACTURING THERMOFORMED DISPOSABLE LID FOR A DRINKING CUP WITH INTEGRATED STRAW MOUTHPIECE PORTION AND MULTI-LEVEL PUNCH

FIELD OF THE INVENTION

A disposable lid for a drinking cup made as an integrated combination straw and lid and methods of use and manufacturing said lid. Method of manufacture includes using a preferred method of thermoforming with polymeric material. The material can include a variety of polymers such as PET, PETE, RPET (Polyethylene Terephthalate), PP (polypropylene), PS (polystyrene) and the like, and implementing a particular manufacturing process described within this application. Said invention comprises several unique features including an integrated hollow cylindrical straw-like mouthpiece, which protrudes a significant height above the upper surface of a drinking cup lid, with no descending portion beneath the lid. Said invention further comprises the introduction, use and formation of indentations for the purpose of finger placement to ensure the stability and security of the lid when applied attachably to the opening of a drinking cup for the process of drinking beverages by method further described in the application. Said invention also features a pressure equalization valve to allow an unrestricted flow of beverage without forming a vacuum within the drinking cup.

BACKGROUND OF THE INVENTION

Events that happen in the world often form opportunities for new inventions. Shortages teach us to conserve. Pollution teaches us to reduce or recycle what otherwise would wind up in landfills and waterways. Today, areas of our world are overrun with waste.

With the introduction of plastics, which are made from petroleum, came the age of convenience. Plastic content is in almost everything we use on a daily basis, from cell phones to clothing, and everything in between. While plastic products themselves cannot biodegrade they often can be repurposed or recycled, preventing them from entering the waste stream. Particular plastics, such as PET, RPET or PETE which are Polyethylene Terephtalate are the most readily recycled materials in most communities with recycling centers. Other polymers, such as PS (polystyrene), PP (polypropelene) and the like are typically used in manufacturing drinking cup lids, usually in injection molding and sometimes used with thermoforming, but are not as readily recyclable, and can be recycled only in centers which accept such polymers. For these reasons, PET, or recycled PET (RPET) is the preferred blend, although not limited to this particular polymer, for the present invention, which includes method of manufacture with thermoforming.

The items used in food service to consume beverages, such as cups, lids and straws, are examples of disposable or single use plastics that are used and discarded hundreds of millions of times daily throughout the world. Such disposable plastic has become a primary concern of scientists and ecologists who observe and monitor the amount of plastics in our waste stream. Because one individual literally can, and often does, use multiple plastic cups, lids and drinking straws in a single day, the amount of plastic beverage waste is staggering.

Drinking straws, in particular, have come into focus by environmentalists as a hazardous waste of sorts, due to the shape and appeal to marine and wildlife who often mistake them for food. Originally fashioned from reeds in centuries past, then more recently, spiraled glued paper, plastic is primarily the material of choice for forming the long, thin, hollow tubes known as drinking straws. Because of their appeal, discarded plastic drinking straws, or even drinking straws made of any other material, can cause serious injury or even death to an unsuspecting marine or wildlife creature.

The production of disposable cups, lids and drinking straws is a separate and individual process. Often, a manufacturer that produces one of these items, may not produce the others. Therefore, those in the food industry must purchase and stock the items individually to make a complete set. The present invention is a combined and integrated straw and lid, which reduces the inventory and amount of space needed for storage as well as shelf space for display and use purposes by customers. For the purpose of this application, the focus of the present invention is on combining the two pieces into one, therefore eliminating a separate lid and drinking straw and effectively reducing the amount of plastic needed to produce both pieces by half.

The present invention may be compared with prior art such as child's sippy type cup lids and traditional drinking straws.

The present invention is unlike toddler's sippy type cup lids, in which the mouthpiece is often angular, oval or rectangular in nature, which makes them nearly impossible to close lips securely around, and allows the beverage to seep around the mouth messily. The end of a sippy cup mouthpiece is ordinarily purposefully restricted with small holes or slits punched in the drinking tip or with an inward turning opening where the child is to draw out the beverage with a strong sucking action, perhaps to emulate the sucking action used in an infant's bottle, and apparently intended to transition a child from a bottle to a traditional drinking cup. Such design, which is typical for a sippy type child's lid, is meant to be spill proof, making it difficult to use for a variety of beverages and unappealing to and not feasible for older children and adults.

The action of having to suck with a traditional straw, drawing the beverage up from the bottom of a cup, also can cause unattractive creasing of the lips to form the vacuum needed to bring the beverage the length of the traditional straw, which is generally a minimum of 8", and even more so when the beverage is thick or frozen. With thicker beverages, it often takes several hard sucking efforts to bring the beverage up the length of the straw to even achieve the first taste. Liquid beverages are easier to draw up with a sucking action, but can be impeded by ice or have to be repositioned to get the last drops. The length of a traditional drinking straw also can create a hazard, as it reaches to the bottom of a cup, which provides resistance when the consumer is drinking from it. Should the consumer be in motion while drinking from a traditional drinking straw, whether in a vehicle or walking, and stumble or hit a bump, or even not paying attention, the sharp edge of the top opening of the straw can be jammed into the mouth or areas of the face, and cause serious injury. Thousands of such accidents involving straws have been presented in emergency rooms throughout the Unites States. Such incidents along with the injuries to marine and wildlife, have led to legislation in some states and countries to outlaw or eliminate the use of traditional drinking straws altogether.

Still other "strawless lids" drink-through lids, such as used with coffee cups with small drinking holes punched around the rims or very large holes instilled on a sloping plane of a lid offer little in the way of comfort or convenience and still are difficult to form a mouth around to satisfyingly drink a beverage. Both of these types of openings cause the user to tip the head backward to sip the beverage, obstructing the users point of view, even temporarily, to avoid pushing the lid into the nose while drinking. Should the user be driving or walking at the time, such as is typical of those who purchase beverages in these types of cups, even a temporary obstruction of view can be dangerous. The larger hole openings also are open invitations for spillage, which can pose additional problems, especially if the beverage is hot.

Until this invention, cups with drink-through mouthpieces have been short, angular, obstructive and unappealing. Patent US 20080035653 A1, Nancy Meli, referred to as a "sippy cup" for toddlers and older children, describes a flattened mouthpiece with obstructive holes to prevent leakage. Patent U.S. Pat. No. 6,883,677 B2, Goeking Whitmore, Shultz and Behnke describes an angular, obstructive protruding mouthpiece. Numerous design patents, including: Des. 407,269, Fletcher; Des. 316,517, Coy; U.S. D718,087 5, Marasligiller, et al.; U.S. D848,217 5, Wall; U.S. D850,208 5, Han; U.S. Pat. No. 0,561,522 5, Gordon all portray protruding and often angular mouth pieces with leak proof obstructions conducive for toddlers and young children. Other prior art teaches using an attached straw in its entirety. U.S. Pat. No. 10,799,047 B2, Lockhart and Goff, Sr.; U.S. Pat. No. 7,516,862 B2, McDonough; U.S. Pat. No. 7,178,685 B2, Hidalgo, Powers, Sinton, Brewin and Hession, teach a separate straw, cup and lid. Yet other prior art including: U.S. Pat. No. 0,810,506 S, Erickson et al; and U.S. D887,775 S, Bo, teach flip up straw portions, not integrated and molded as one piece. U.S. Pat. No. 10,869,567 B2, Althaher, et al. defines a raised portion that may incorporate a separate straw.

The present invention prevents all of the problems described previously with traditional straws, toddler sippy cups and strawless lids, and provides an ergonomically shaped design to provide the user with a safe, simple and satisfyingly effortless method as a means of drinking beverages from a cup.

SUMMARY OF THE INVENTION

The present invention is a combination of the disposable cup lid and drinking straw, merging the two into one unbroken molded piece with a unique sharply upswept straw mouthpiece of significant height of approximately 1" to give the appearance, feel and action of a traditional drinking straw, but without the straw and no descending portion beneath the bottom of the lid as a means for drinking beverages from a cup. Said lid can be reusable as well. This invention will be referred to in this application as a "straw-lid."

The appearance of said invention is reminiscent of a 1" segment of hollow tube drinking straw attached to the top of a standard drink cup lid. The shape of the straw mouthpiece is round and narrow, similar to an actual straw, the size is approximately ½" in diameter with a significant round hole of at least ¼" diameter making an unrestricted opened end such as the typical drinking straw. This allows the straw-lid to be used for a variety of beverages, including water, soda, and thicker beverages such as milk shakes, ice smoothies, iced drinks, boba teas (aka currently popular "bubble teas" made with tapioca) and the like. Using said invention on a cup containing a frozen or thick beverage allows the user to immediately start consuming the beverage rather than having to wait for the frozen or thick beverage to warm and liquefy, as when using a traditional straw.

The straw portion of the present invention extends significantly above the lid surface in an almost sharp, nearly 90 degree upturn to provide the user with the experience of drinking from a straw, yet has no descending portion beneath the underside of the lid. A pressure equalization valve presents as a small hole funneled into a raised platform, usually opposite the straw mouthpiece portion, to allow proper airflow when the open straw end is in use and covered in its entirety by the mouth. Without pressure equalization, continuous sucking action on the straw mouthpiece would create a vacuum within the beverage cup itself, and cause implosion as well as impede the flow of the beverage. The pressure equalization valve allows ease of flow and the user can drink normally without having to pause, remove the mouth and allow the cup to refill with air. The spaciously rounded rim of the straw-lid is carefully designed to accommodate the openings of a variety of cup styles and materials of the same circumference, such as styrofoam, paper, plastic, acrylic, glass and the like, which all have different rim edges, such as rolled, straight or thickened, and is secured in place by a contour crease beneath the outer lid rim. The crease devolves into a continuous band that is formed inward to secure itself to the upper edge of the cup on the outside, while the recessed lid surface secures the lid from the inside, forming a leak-proof seal. The bottom edge, or skirt, of the straw-lid is formed outward to accommodate removal for purposes of refilling or to discard or recycle after use.

The method of tipping and sipping is implemented, with the user tipping the cup with the straw-lid bottom upward, allowing gravity to draw the beverage into the straw mouthpiece and into the users mouth without the need for a sucking action and without having to tilt the head backward to avoid hitting the nose on the surface of the lid. While the height of the straw mouthpiece of the present invention is sufficient to allow space for facial features, the present invention also allows for finger indentations to be presented on the lid surface which can vary in depth and length, encouraging the user to place a finger into the indentations to provide extra security of the lid when tipping the beverage cup bottom upward and toward the mouth.

The hole opening of the straw-lid mouthpiece being slightly smaller in circumference than the formed straw mouthpiece portion itself, provides a naturally formed rounded rim, which offers a smooth edge for the user. Traditional plastic straws, made by extruding hollow plastic tubing, and being cut to length, usually a minimum of 8.5" for a traditional length straw, have naturally sharp, open ends, the edges being the thickness of the straw itself. The cut end of a traditional drinking straw, which is sharp and can cause injury if jammed into the roof of a mouth or part of the face while attempting to drink from the opening, particularly while in motion, or if the user is young, inexperienced with straw drinking or has limited or hindered abilities, poses risks of injury to the user.

The present invention of the straw-lid offers a comfortable and familiar way of drinking from a cup for those who cannot or should not use a traditional straw. Typically for medical purposes, such as dental procedures, post-surgery, or for gastric reasons, traditional drinking straws are not recommended for use due to the sucking action needed to consume a beverage. The straw-lid provides the feel of a straw, without the need to create a sucking action to consume a beverage from a cup.

The comparison of the present invention with a toddler's sippy cup, traditional drinking straw and contemporary "strawless" or drink-through lids shows the stark difference, as the straw-lid is much safer and easier to use. By the action and method of tipping the cup holding the beverage and drinking through the unrestricted hole in the straw mouthpiece, the action allows gravity, liquid and weight to draw or funnel the beverage into the hollow straw mouthpiece, and to flow unimpeded into the mouth. The straw-lid, as a means for drinking beverages from a cup, simply makes sense.

These are among the many reasons for the invention of the straw-lid:

1) To eliminate the need for a separate straw and lid,
2) To reduce the amount of plastic needed to produce a straw and lid separately by eliminating the need for a straw,
3) To utilize a material that is easily recyclable and may be produced of recycled content, reducing plastics from the waste stream,
4) To provide a safe alternative to the straw, which by its length and placement in a cup may cause injury or harm to the user,
5) To appeal to all ages and abilities of users,
6) To eliminate straw disposal that endangers marine and wildlife,
7) To provide the non-obstructive, free flowing experience of a straw, without the straw!

Manufacturing the present invention, the straw-lid, poses a challenge to the plastic food container industry. In order to achieve stability with the drastic height variation with hole punches on multiple levels, the lid must be made in a particular manner, previously not used in the manufacture of drink cup lids.

There are two general methods of manufacturing disposable plastic lids: Injection molding and Thermoforming. While thermoforming is primarily used for large scale designs and shorter production runs, injection molding is typically used for smaller parts and large production runs. Thermoforming, however, is the most cost effective, more flexible route and is the preferred method for speed and efficiency in manufacturing and will be the primary choice for the method of manufacturing the straw-lid.

Processes for shaping the heated plastic to the molds will involve one of several procedures. Vacuum forming is particularly cost effective and used for packaging. Pressure forming is used for durability and uniformity. Mechanical forming is for high quality and precision. Drape forming is for larger components. Matched molding is expensive and for more detailed durable parts. Twin Sheeting molding is for double walled items. Pillow forming is for low production items such as sky lights. Vacuum forming, Pressure forming, Matched Metal forming or any combination thereof may be used to form the present invention.

Thermoforming involves the heating of a plastic sheet to the surface of a "male" or "female" mold. A "male" mold requires the thermoplastic sheet to be placed over the outside of the mold, while the "female" mold has the thermoplastic sheet placed and formed within. The sheeting is pressed to the outer or inner sides of the mold, depending on if it is "male" or "female," using one of the methods of forming previously mentioned. A "male" formed mold will produce a more defined inner construction of a finished product while a "female" formed mold will be more defined on the outside of a finished product. A degree of draft is generally used to release the cooled and formed sheet from the mold. This is needed more with a "male" mold than a "female" mold as the thermoforming process will produce a tighter fit around the "male" mold while the "female" mold tends to shrink inward when cooling, away from the inner part of the mold itself. Holes are then punched, as needed and a steel rule die is then used to trim around and release the molded shape.

When thermoforming, the highest point of the mold is the first contact with the heated polymer which cools first and produces the strongest feature. Disposable cup lids and lids in general are formed using a "female" mold. This requires the polymeric film or sheeting to be formed, via vacuum, within the mold, then slits are made by cutting inside against the mold surface and around the formed lid to release the finished product. This is standard procedure for thermoformed drink cup lids.

The desired effects of the present invention are produced using a non-traditional "male" mold in a thermoforming process to provide the significant height of the straw portion of the lid with structural stability with the pinnacle of the straw portion receiving the first formed, or thickest, plastic. The die cut then must be made using a double punch on two levels to produce the opening in the end of the straw portion and the pressure release valve on the lid surface and to cut around the lid itself with a height difference of more than one inch. A vacuum assist must be implemented to remove the punched hole piece in the straw portion to avoid "tabbing." To accomplish these steps, the present invention essentially must be made using a "male" mold from a "female" perspective.

DETAILED DESCRIPTION OF THE DRAWINGS

Figure 1:
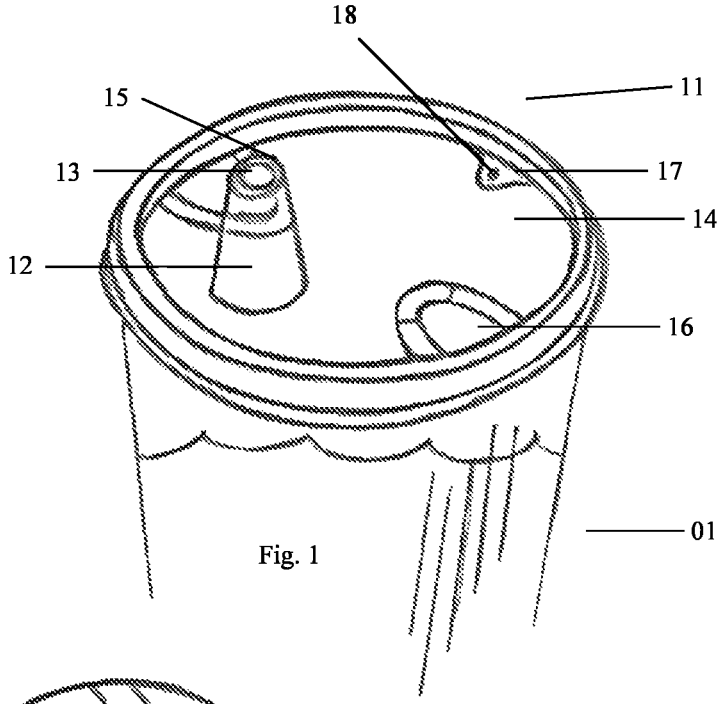
FIG. 1 Comprehensive view of the straw-lid on a cup
Figure 2:
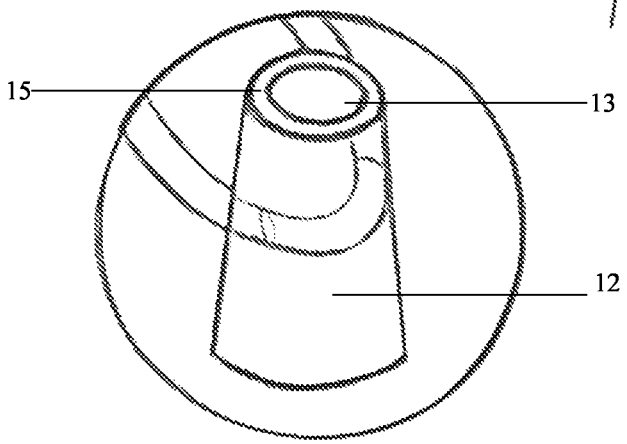
FIG. 2 Exploded view of the straw mouthpiece and rim

FIG. 1 on drawing Page 1 of 4, depicts a comprehensive view, showing the straw-lid 11 secured to the opening of a drinking cup 01. The primary feature of the straw-lid 11 is the straw mouthpiece 12, which is a hollow tube, protruding and rising up from the surface 14 of the straw-lid, with no descending portion. The opening 13 of the straw mouthpiece 12 is smaller than the outer circumference of the straw mouthpiece 12, which forms a naturally rounded rim 15 for comfort and safety while in use. The straw-lid 11 includes a pressure equalization valve 17 which presents as a raised portion on the surface of the straw-lid 14. An inward funneled hole 18 is present in the valve 17 which encourages air flow and equalization while the opening 13 of the straw mouthpiece 12 is fully covered by the user while drinking. This prevents a vacuum from being formed within the cup 01 which would impede the flow of the beverage. The straw-lid features finger indentations 16 to indicate the user can place a finger on the lid to provided extra security and comfort while drinking using the tip and sip method. FIG. 2 is an exploded view of the straw mouthpiece 12, the opening 13 and the rounded rim 15.

Figure 3:
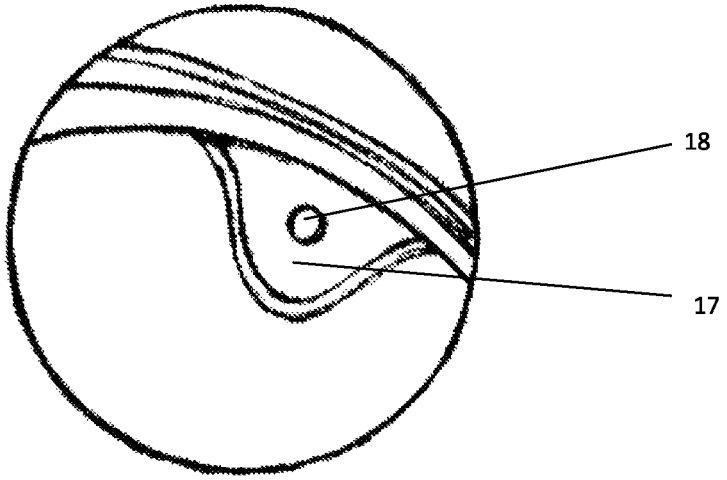
FIG. 3 Exploded view of the pressure equalization valve

FIG. 3 is an exploded view of the pressure equalization valve platform 17 with the inward funneled hole 18.

Figure 4:
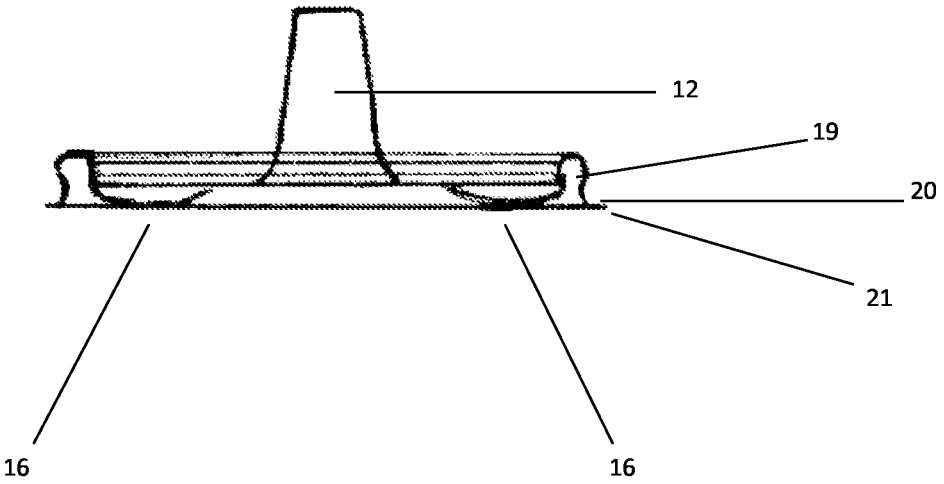
FIG. 4 Cross sectional view of the straw-lid

FIG. 4 is a cross sectional view of the straw-lid 11 which features the straw mouthpiece 12, finger indentations 16 and a rolled rim edge 19 with continuous security band 20 and an bottom edge or skirt 21 for lifting and removing the lid. A center axis intersects the upper surface at a location defining a center point. As can be seen in FIGS. 1 and 4, the straw mouthpiece portion is offset from the center point, and a clearance is defined by the upper surface between the straw mouthpiece portion and the rolled rim edge, and the clearance is fully circumferential of the straw mouthpiece portion.

Figure 5:
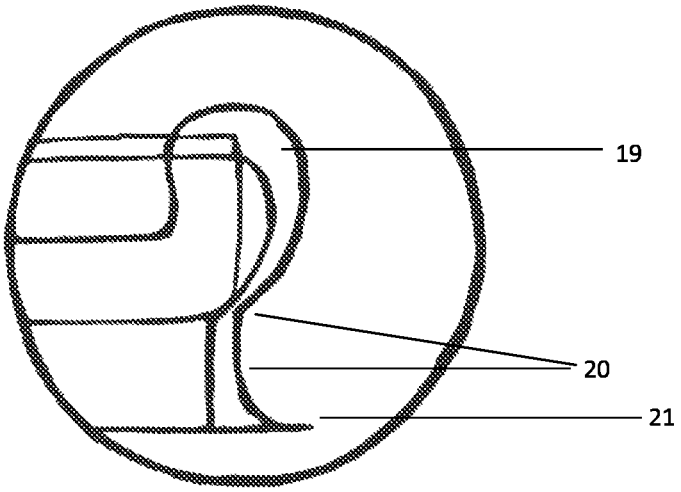
FIG. 5 Exploded view of straw-lid rim

FIG. 5 Shows an exploded view of the rolled edge 19 of the rim of the straw-lid 11. The continuous security band 20 is formed under the rolled edge 19 and the bottom edge, or skirt 21 is formed outward to accommodate lid removal for refilling or discarding and recycling.

Figure 6:
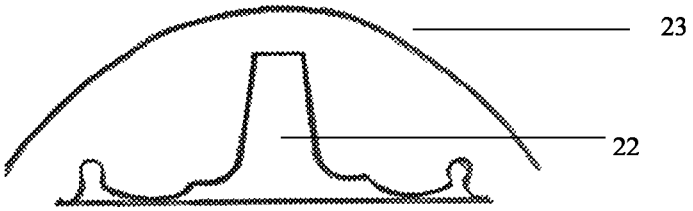
FIG. 6 Method of manufacture process, mold and heated plastic
Figure 7:
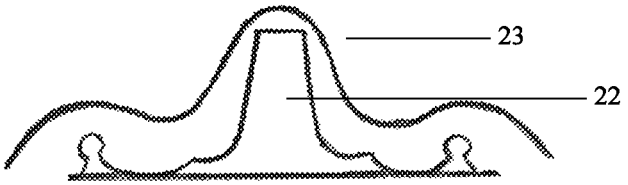
FIG. 7 Method of manufacture process, thermoforming
Figure 8:
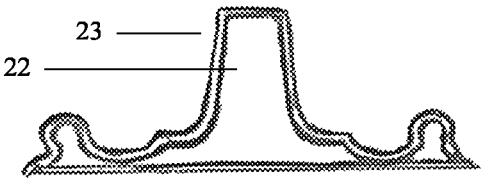
FIG. 8 Method of manufacture process, heated plastic formed to the mold
Figure 9:
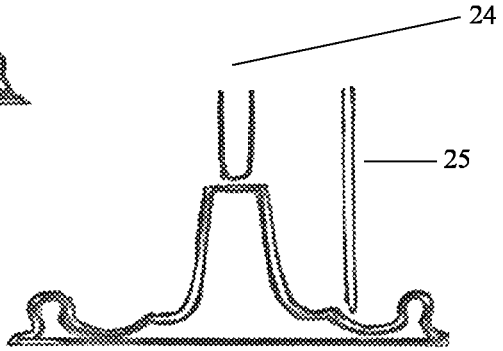
FIG. 9 Method of manufacture process, multi-level hole punch in finished produce before it leaves the mold FIG. 10 Illustration of the method of tipping and sipping from a straw-lid showing use of the finger indentations to offer security and stability while drinking a beverage

FIG. 6 depicts a cross sectional view of the mold 22 for the straw-lid. The heated plastic 23 covers the mold 22 from above and the heated plastic 23 settles around the outside of the mold 22 in FIG. 7, indicating this is a "male" mold. The heated plastic 23 is vacuumed from underneath the mold 22 to draw the heated plastic 23 tightly to the mold 22 in FIG. 8. FIG. 9 indicates the multi-level hole punch 24, 25, to form the hole 13 in the end of the straw mouthpiece 12 of the cooled plastic which is now the finished product. The holes are removed with a vacuum assist for complete removal to prevent tabbing.

Figure 10:
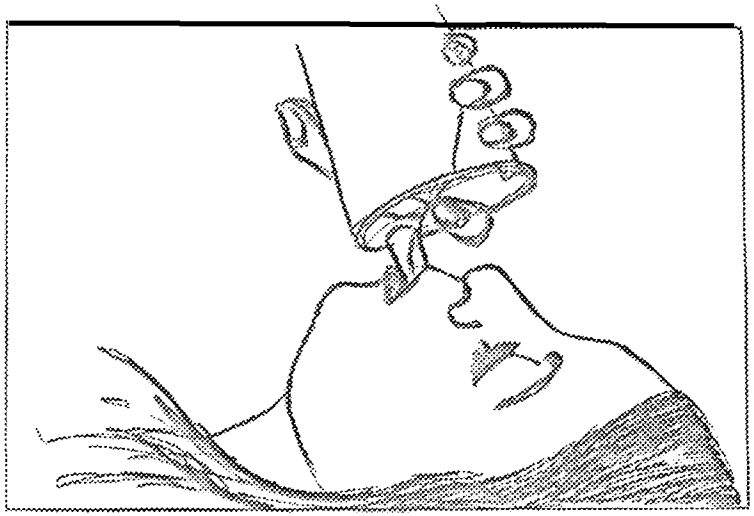

FIG. 10 illustrates the method of tipping and sipping from the straw-lid, using the finger indentations for stability and security while drinking a beverage. The finger indentations offer the suggestion of using a finger to further secure the straw-lid to the cup rim. The tipping and sipping method is designed to move a beverage from a drinking cup into the straw mouthpiece of the straw-lid by raising the cup and allowing gravity, liquid and weight to encourage the flow through an unimpeded straw mouthpiece without having to tilt the head back.

What is claimed is:

1. A drinking cup lid molded as a single piece integrated straw and lid combination, consisting of:

a lid surface extending circumferentially around a center axis and having an upper surface and a lower surface, the center axis intersecting the upper surface at a location defining a center point;

a straw mouthpiece portion having a hollow tubular portion rising sharply from the upper surface of the lid surface with a circular top opening at the pinnacle of the straw mouthpiece portion and circular bottom opening from the bottom side of the lid, so as to form a frustoconical shape including, in profile, straight sides extending from the upper surface to the pinnacle of the straw mouthpiece portion; and a rolled rim edge surrounding the lid surface;

wherein the upper surface extends between the straw mouthpiece portion and the center point in a radial direction defined by a circle, centered on the center point, and the upper surface extends between the straw mouthpiece portion and the rolled rim edge in the radial direction;

wherein the upper surface is unobstructed in the radial direction between the straw mouthpiece portion and the center point and the upper surface is unobstructed in the radial direction between the straw mouthpiece portion and the rolled rim edge;

wherein the straw mouthpiece portion includes no portion descending below the lid surface;

wherein the top opening of the straw mouthpiece portion is coaxial with the bottom opening of the straw mouthpiece portion and the hollow tubular portion is unimpeded from the top opening to the bottom opening;

wherein the bottom opening of the straw mouthpiece portion is positioned below the rolled rim edge;

wherein the height of the straw mouthpiece portion rising sharply from the upper surface to the pinnacle of the straw mouthpiece portion is 1 inch, and the circular top opening of the straw mouthpiece portion is ¼ inch.

2. The drinking cup lid of claim 1, wherein the rolled rim edge is shaped so as to fold around the upper rim of a cup and secure the drinking cup lid to the cup.

3. The drinking cup lid of claim 1, wherein the rolled rim edge further includes a flared bottom edge which may be leveraged to remove the drinking cup lid from a cup.

4. The drinking cup lid of claim 1, further comprising indentations formed into the lid surface to illustrate and encourage fingertip placement.

5. The drinking cup lid of claim 1, further comprising a rounded edge to the straw mouthpiece portion.

6. The drinking cup lid of claim 1, further including a pressure equalizing valve to equalize air pressure inside the cup during use.

7. The drinking cup lid of claim 6, wherein the pressure equalizing valve is an inward formed hole punch raised above the lid surface.

8. A drinking cup lid molded as a single piece integrated straw and lid combination, consisting essentially of:

a lid surface extending circumferentially around a center axis and having an upper surface and a lower surface, the center axis intersecting the upper surface at a location defining a center point;

a straw mouthpiece portion having a hollow tubular portion rising sharply from the upper surface of the lid surface with a circular top opening at the pinnacle of the straw mouthpiece portion and circular bottom opening from the bottom side of the lid, so as to form a frustoconical shape including, in profile, straight sides extending from the upper surface to the pinnacle of the straw mouthpiece portion; and a rolled rim edge surrounding the lid surface;

wherein the straw mouthpiece portion is offset from the center point, and a clearance is defined by the upper surface between the straw mouthpiece portion and the rolled rim edge, and the clearance is fully circumferential of the straw mouthpiece portion;

wherein the straw mouthpiece portion includes no portion descending below the lid surface;

wherein the top opening of the straw mouthpiece portion is coaxial with the bottom opening of the straw mouthpiece portion and the hollow tubular portion is unimpeded from the top opening to the bottom opening;

wherein the bottom opening of the straw mouthpiece portion is positioned below the rolled rim edge;

wherein the height of the straw mouthpiece portion rising sharply from the upper surface to the pinnacle of the straw mouthpiece portion is 1 inch, and the circular top opening of the straw mouthpiece portion is ¼ inch.

* * * * *